United States Patent [19]

Schneppendahl et al.

[11] 4,071,750

[45] Jan. 31, 1978

[54] LIGHT DIFFUSER AND LAMP INCORPORATING THE SAME

[75] Inventors: Richard Schneppendahl, Konigsdorf; Heinrich Kramer, Lovenich; Franz Pepping, Pulheim, all of Germany

[73] Assignee: Nova-Lux-Gesellschaft Brandenburg & Co., Cologne, Germany

[21] Appl. No.: 632,171

[22] Filed: Nov. 14, 1975

[30] Foreign Application Priority Data

Dec. 16, 1974 Germany ..... 2459327

[51] Int. Cl.[2] ..... F21V 5/00

[52] U.S. Cl. ..... 362/217; 362/339

[58] Field of Search ..... 240/106 R, 92, 93, 78 LK, 240/73 BC, 106.1, 103 R, 51.11 R, 151, 25, 147

[56] References Cited

U.S. PATENT DOCUMENTS

| | | | |
|---|---|---|---|
| 1,707,038 | 3/1929 | Bauersfeld | 240/103 R X |
| 1,746,852 | 2/1930 | Champeau | 240/106 R UX |
| 2,318,716 | 5/1943 | Rolph | 240/51.11 R |
| 2,474,317 | 6/1949 | McPhail | 240/106 R |
| 2,474,341 | 6/1949 | Wince | 240/106 R X |
| 2,732,488 | 1/1956 | Wince | 240/93 |
| 3,502,865 | 3/1970 | Matteson | 240/106.1 |
| 3,721,818 | 3/1973 | Stahlhut | 240/106 R |

FOREIGN PATENT DOCUMENTS

| | | | |
|---|---|---|---|
| 1,133,367 | 11/1968 | United Kingdom | 240/106 R |

*Primary Examiner*—Donald A. Griffin
*Attorney, Agent, or Firm*—Spencer & Kaye

[57] ABSTRACT

A lamp includes a light source having a center and a light diffuser disc having two opposite faces and supported at a distance from the light source. One face of the light diffuser disc is provided with a prism structure which is symmetrical with respect to a normal that passes through the center of the light source and that is perpendicular to the faces of the light diffuser disc. The prism structure is formed of a plurality of prisms extending parallel to one another; each prism has a frontal flank oriented towards the normal and a rear flank oriented away from the normal. The angle of inclination of the frontal flanks gradually decreases from prism to prism in a direction away from the normal, while the angle of inclination of the rear flanks gradually increases at a decreasing rate, from prism to prism towards an upper limit value in a direction away from the normal.

23 Claims, 8 Drawing Figures

FIG. 3a
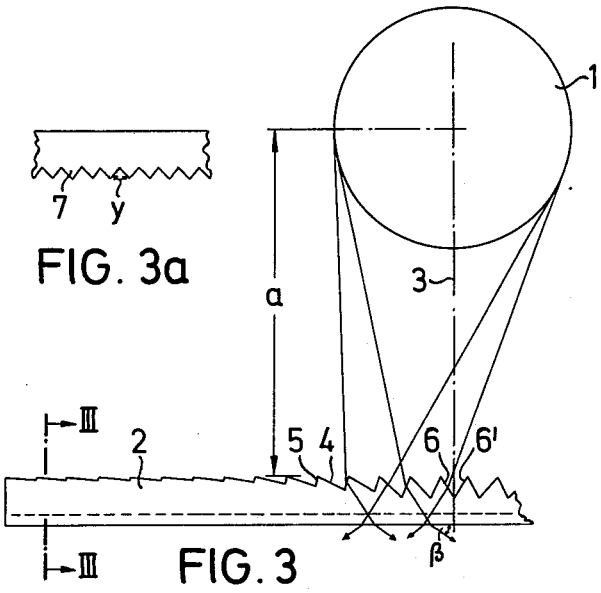
FIG. 3
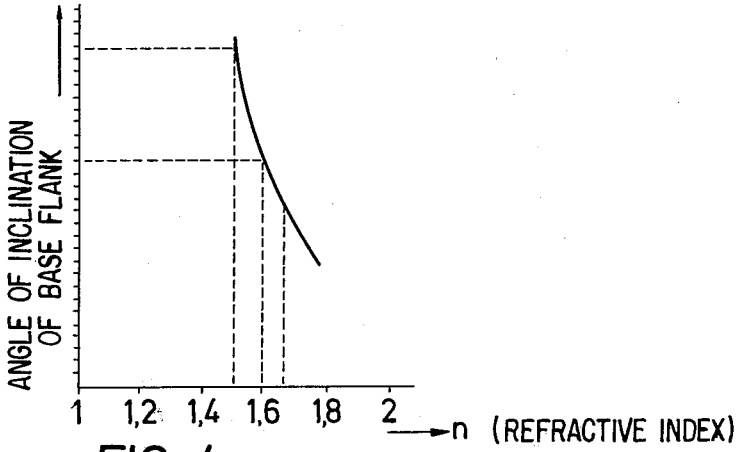
FIG. 4
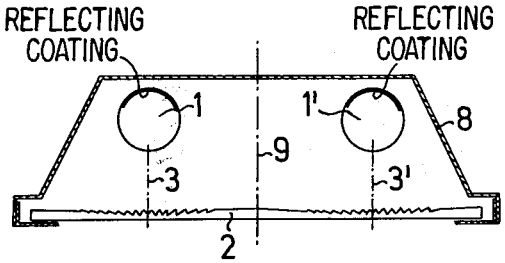
FIG. 7

LIGHT DIFFUSER AND LAMP INCORPORATING THE SAME

BACKGROUND OF THE INVENTION

This invention relates to electric lamps primarily designed for illuminating rooms and having a light diffuser disc which is provided, at least on one face, with a prism structure for deflecting light and for distributing the light density. The light source, such as an electric bulb (point-like light source) or a fluorescent tube (linear light source) is situated at a distance from the diffuser disc.

For designing the illumination in offices, work halls, classrooms and the like, a number of criteria has to be taken into consideration to achieve a "correct" and economical lighting. Thus, the lamps have to be arranged in such a manner that there is achieved, in the entire room, a substantially uniform light intensity distribution and further, for each work position, there is obtained an approximately uniform light density (brightness). Further, the possibility of glare, either by reflection from a surface, such as a desk, or by direct radiation from a lamp situated in the line of vision of a person in his working position, should be excluded.

In earlier attempts these multiple, often partially contradictory criteria were sought to be met by providing the lamp with a closure of translucent or matte glass or translucent synthetic glass. Recently, because of the poor light efficiency resulting from the use of translucent glass, transparent material has been used for lamp closures in order to increase the light efficiency. In order to meet the problems of light density (brightness) and light distribution which, in case of transparent material, is substantially more difficult, at least one face of the transparent diffuser disc has been provided with a prism-like structure with which a light distribution of a certain degree could be effected by means of light deflection. While, with the known diffuser discs having such a prism structure, the problem of the so-called direct glare could be substantially solved, problems of the glare by reflection, that is, the limitation of the admissible maximum value of the light density in an angular range of 0°–45 ° (that is, immediately below the lamp) could, however, not be satisfactorily solved for the required light intensities. The light distribution curves, which can be obtained with prism structures known heretofore, require the use of a relatively large number of lamps to achieve a substantially uniform light distribution illumination in the entire room for avoiding "holes" in the room lighting.

SUMMARY OF THE INVENTION

It is an object of the invention to provide a lamp having an improved light diffuser disc with which an optimal light distribution curve can be obtained.

This object and others to become apparent as the specification progresses, are accomplished by the invention, according to which, briefly stated, one face of the light diffuser disc is provided with a prism structure which is symmetrical with respect to a normal that passes through the center of the light source and that is perpendicular to the faces of the light diffuser disc. The prism structure is formed of a plurality of prisms extending parallel to one another; each prism has a frontal flank oriented towards the normal and a rear flank oriented away from the normal. The angle of inclination of the frontal flanks gradually decreases from prism to prism in a direction away from the normal, while the angle of inclination of the rear flanks gradually increases, at a decreasing rate, from prism to prism towards an upper limit value in a direction away from the normal.

In case the light source is substantially linear, the normal is a plane which contains the longitudinal axis of the light source. In case the light source is substantially point-like, the normal is a line which contains the center point of the light source.

With a lamp having a light diffuser disc of the above-outlined structure, a light distribution curve of an approximately heart-shaped course is obtained; the lamp is located at the "tip" of the curve, whereas the deepest location of the indentation of the heart-shaped curve is vertically below the lamp (assuming the lamp is attached for downward illumination). It is a result of a light distribution curve of the above-outlined course that vertically underneath the lamp the light intensity is lesser than in the adjacent areas and further, the light intensity increases from the minimum value to a maximum value in a horizontal direction away from the lamp. This means that in the critical angular zone of between 0° and 30° with respect to the normal line (in case of a substantially point-like light source) or with respect to the normal plane (in case of a substantially linear light source), a glare by reflection is practically eliminated due to the reduction of light intensity by virtue of the diffuser disc designed according to the invention. This is so because light contrasts between the critical angular zone and the adjoining angular zones cannot take place due to the higher light intensity in the adjoining areas. By virtue of the prism structure designed according to the invention there is further ensured a freedom from glare also in the zone of the direct glare, that is, between 45° and 90° measured with respect to the normal.

The light distribution curve obtained with a diffuser disc structured according to the invention leads to the further advantage that there can be achieved a uniform illumination of a room with a fewer number of lamps than it has been possible heretofore. This is so because due to the increase of the light intensity in the zone between 30° and 60° with respect to the normal, the distance to the adjoining lamp may be increased without thereby generating "holes" in the light intensity distribution regarding the entire room. Thus, as an end result, there is achieved a more uniform light intensity with significantly improved efficiency of illumination, a reduced glare by reflection and a greater proportion of directed light which increases perspective vision.

According to a preferred embodiment of the invention the prisms extend annularly on the disc surface. Such a diffuser disc may find particular application in lamps with approximately point-like light sources such as normal electric bulbs. In such a case the normal is a line and the prisms are concentric therewith.

According to another preferred embodiment of the invention, the prisms extend linearly. This embodiment finds application in linear light sources, such as fluorescent tubes of the type widely used for illuminating office spaces, work rooms or classrooms and are used in groups to form light strips. In case of a linear light source the normal is a plane and the prisms extend parallel thereto.

According to the invention, it is further provided that the prism flank (base flank) adjoining the normal, has a foot point or foot line which lies in the normal. With this arrangement it is ensured that even the vertically downwardly directed light beam portion, which can be controlled only with difficulty by light deflecting means, is, to a great extent, deflected away from the normal to obtain the desired light distribution curve.

According to the invention, the ratio between the angle of inclination of the base flank (that is, the flank which is oriented towards the normal and which belongs to the prism adjoining the normal) and the refractive index of the material of the diffusor disc is 28° to 40°, i.e. the lower value for the angle results of a higher refractive index and vice versa. In this manner the greatest possible indentation in the light distribution curve measured vertically under the lamp (that is, in the zone of the normal) can be obtained.

Further, according to the invention, the ratio of the angle of inclination of the base flank to the angle of inclination of the adjoining rear flank is approximately 0.8 to 1.0.

Also according to the invention, the other face of the diffuser disc is provided with a secondary prism structure formed of prisms which have uniform, symmetrical cross sections and which extend linearly and perpendicularly to the above-discussed prisms of the reverse face (primary prism structure). The angle of opening between two prism flanks in the secondary prism structure is greater than 90°. By means of a diffuser disc structured in this manner an optimal reduction of glare in the direction of the bulb axis is achieved particularly for elongated bulbs. By means of the predetermined opening angle between any two prism flanks of the secondary prism structure there may be avoided a total light reflection within the disc; thus light losses are reduced.

According to a particularly advantageous embodiment of the invention the primary prism structure is oriented towards the light source since in this manner there are achieved unequivocal conditions of refraction for the individual light beams to thus obtain the desired light distribution based on the light distribution curve which is assumed as ideal. It is further of particular advantage to so arrange the prisms of the primary prism structure that they extend parallel to the longitudinal axis of the light source in case of elongated light sources such as fluorescent lights.

BRIEF DESCRIPTION OF THE DRAWINGS

FIG. 3 is a fragmentary cross-sectional view of a light diffuser disc, on an enlarged scale, structured according to a preferred embodiment of the invention.

FIG. 3*a* is a fragmentary sectional view taken along line III—III of FIG. 3.

FIG. 4 is a diagram illustrating the change of the angle of inclination of the base flank as a function of the refractive index of the light diffuser disc.

FIG. 7 is a schematic sectional view of a lamp having two tubular light sources and incorporating a light diffuser disc structured according to the invention.

DESCRIPTION OF THE PREFERRED EMBODIMENTS

Figure 1:
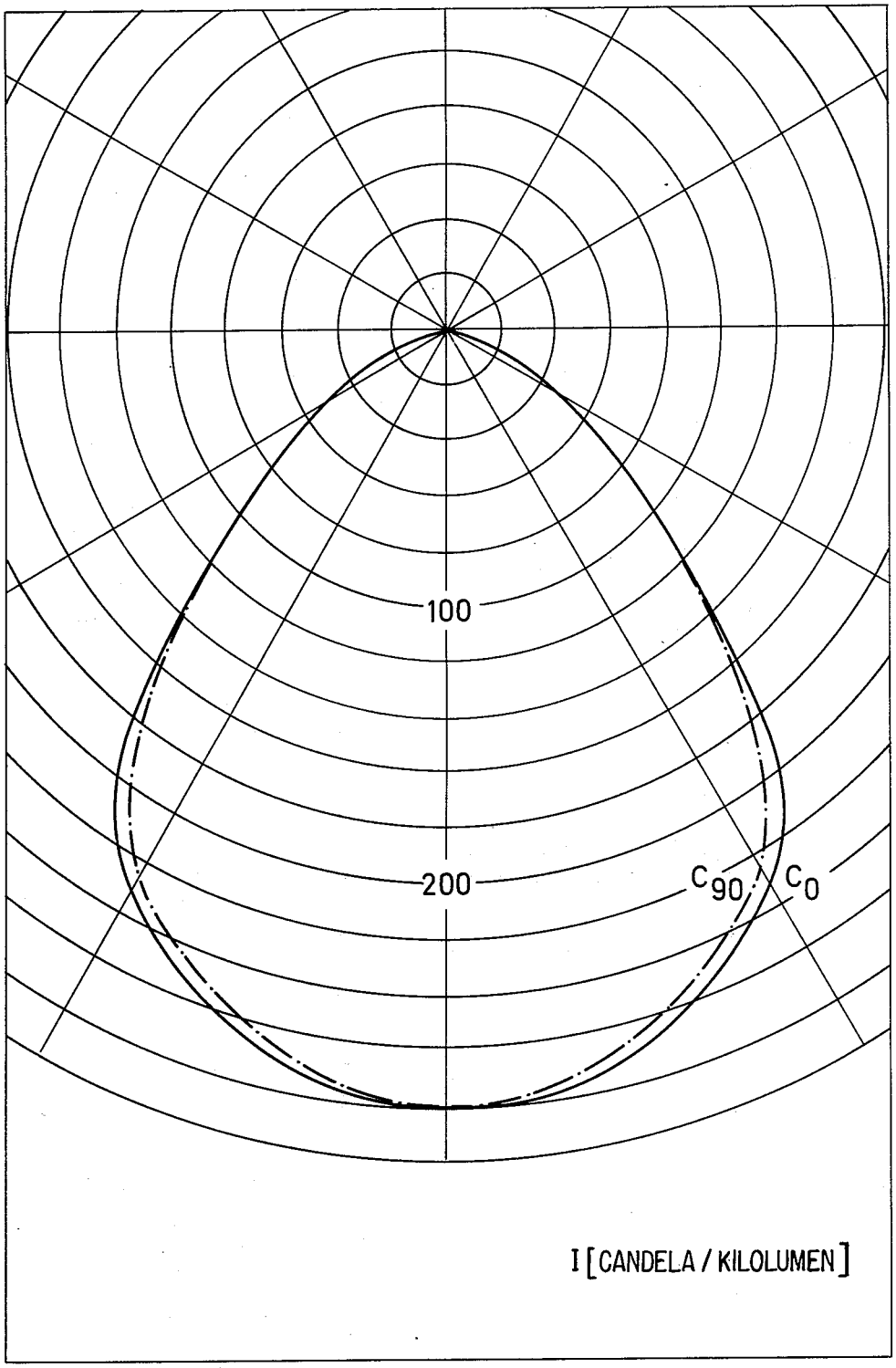
FIG. 1 (PRIOR ART)
FIG. 1 is a diagram illustrating a light distribution curve of a light diffuser disc structured according to the prior art.

Turning first to FIG. 1, there is shown a normalized light distribution curve of a conventional light diffuser disc associated with a lamp having a tubular fluorescent light source. Curve $C_0$ illustrates the light distribution in a plane perpendicular to the axis of the light source whereas curve $C_{90}$ represents the light distribution in a plane extending parallel to the direction of the light source axis. These light distribution curves show that the light intensity I is the greatest in the normal plane (which is a plane that contains the longitudinal axis of the linear light source and is perpendicular to the faces of the light diffuser disc) and well within the critical zone at both sides of the normal plane. In case a substantially uniform illumination of a room is to be achieved with lamps of such light distribution curves, it will be readily apparent that the lamps have to be arranged relatively close to one another. Further, because of the great light intensity in the zone of the normal plane of each lamp (that is, vertically below the lamps when they illuminate downwardly), the problem of glare by reflection is not satisfactorily solved.

Figure 2:
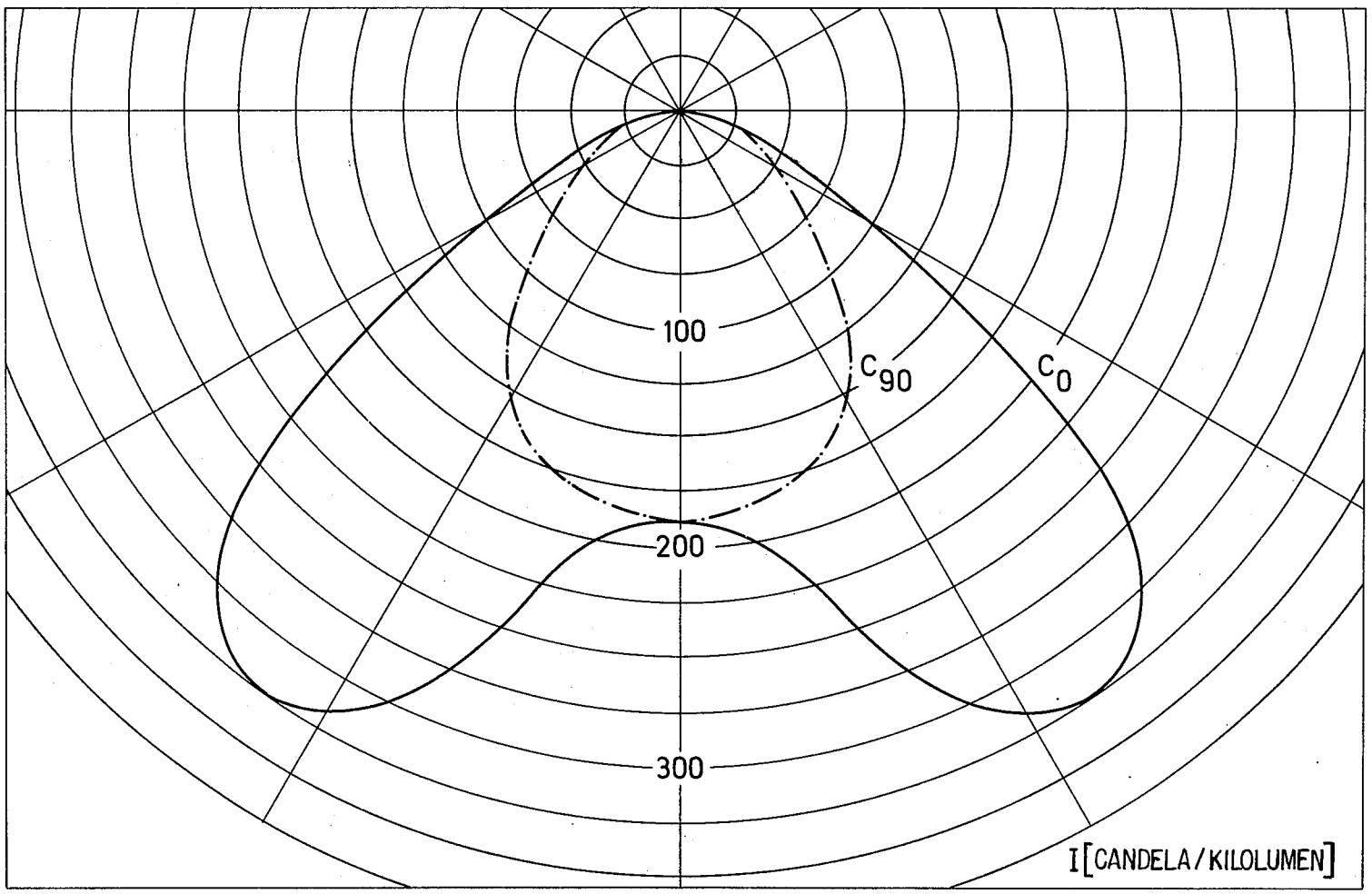
FIG. 2 is a diagram illustrating a light distribution curve of a light diffuser disc structured according to the invention.

In FIG. 2, there is illustrated a light distribution curve characterizing a light diffuser disc structured according to the invention. A comparison with the light distribution curve shown in FIG. 1 clearly demonstrates the substantial advantages which can be accomplished by means of light diffuser discs designed according to the invention. The light intensity is substantially reduced in the zone of the normal plane and laterally thereto, while the greatest light intensity is obtained in the zone between 30° and 60° at both sides of the normal plane. A comparison with the curves of FIG. 1 shows that for an illumination of a larger room the distance between the lamps can be significantly greater without adversely affecting the uniformity of the lighting of the room. Further, due to the significant indentation of the curve in the zone of the normal plane, the problem of glare by reflection is substantially solved. A direct glare is avoided as well because the zone between 45° and 90° remains substantially dark.

Turning now to FIG. 3, there is illustrated schematically and on an enlarged scale, the course of a light beam emitted by a lamp having a fluorescent, tubular light source 1 and provided with a diffuser disc 2 structured according to the invention and fitted into an opening of the lamp housing (not shown in FIG. 3).

The dash-dot line 3 represents a reference plane which contains the longitudinal axis (extending normal to the plane of the drawing) of the light source 1 and which is normal to the faces of the diffuser disc 2. This reference plane is referred to as the normal plane 3. It is apparent that the normal plane 3 extends perpendicularly to the drawing plane of FIG. 3.

On its face oriented towards the light source 1, the diffuser disc 2 is provided with a series of prisms, each extending linearly and parallel to the axis of the light source as well as the normal plane 3. The normal plane 3 is a symmetry plane of the prism structure on the disc 2. As it may be observed in FIG. 3, the configuration of each prism is assymetrical with respect to itself in that it has different flank angles (which is the angle of a prism flank formed with a face of the diffuser disc). The flank angle of the frontal flanks 4 (that is, those flanks which are oriented towards the normal plane 3) gradually decreases from prism to prism in a direction away from the normal plane 3, to a practically zero value. The flank angle of the rear flanks 5 (that is, the flanks which are oriented away from the normal plane 3 on both sides thereof), on the other hand, increases from prism to prism, in a direction away from the normal plane 3, to an upper limit value. The rate of this increase decreases in a direction away from the normal plane 3.

The prisms are so arranged that the frontal flanks of those two prisms which are the closest to the normal plane 3 on both sides thereof and which will be hereinafter referred to as the base flanks 6 and 6', respectively, have a common foot line which lies in the normal plane 3. The magnitude of the flank angle of the base flanks 6 and 6' depends from the optical properties of the material on the diffuser disc 2. This dependence is illustrated in FIG. 4. The base flank angle is between 28° and 40° and depends from the refractive index of the disc material, given a predetermined distance between the axis of the light source and the diffuser disc and given a predetermined light intensity distribution corresponding, for example, to the light distribution curve illustrated in FIG. 2. Thus, the base flank angle has to be adapted to the distance *a* of the axis of the light source from the diffuser disc 2, if a predetermined light distribution curve, for example, a light distribution curve of the shape illustrated in FIG. 2, is to be obtained. In case of a larger distance *a*, the base flank angle has to be accordingly increased.

The presently commercially available light sources, particularly fluorescent tubes, are far from line-like; as shown in the enlarged FIG. 3, they have a dimension also extending in the direction of prism width. This fact has to be taken into account for the determination of the distance of the light diffuser disc from the light source. On the basis of a light distribution curve as illustrated in FIG. 2, it is expedient to so select the distance *a* (FIG. 3) from the center of the light source to the diffuser disc that the ratio of this distance to the diameter of the light source is approximately 1.2 to 2.0, preferably approximately 1.4 to 1.5. This ensures that a light beam orientation such as illustrated for several light rays in FIG. 3, may be achieved which results in the advantageous light distribution curve according to FIG. 2. It is further noted that the exit angle $\beta$ of the light rays emanating from the diffuser disc 2 is not less than approximately 30°, so that the zone which is to be maintained substantially dark to avoid direct glare remains, in fact, dark. It is further noted that the diameter of the light source is usually 38 mm.

Figure 5:
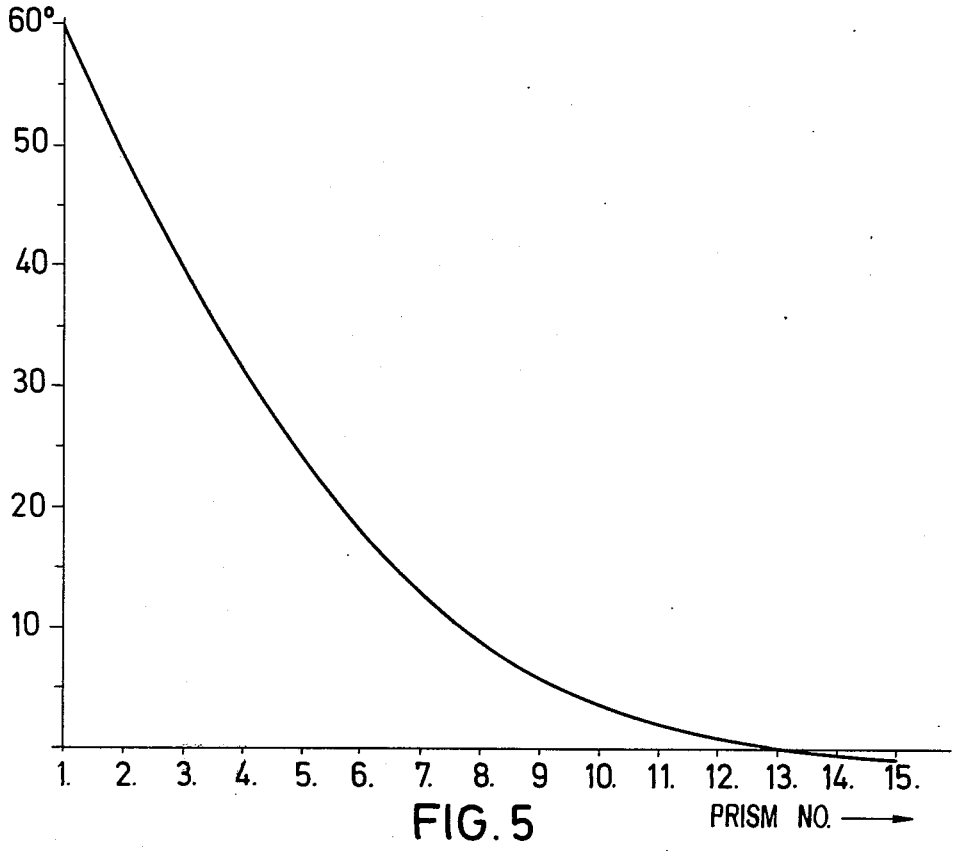
FIG. 5 is a diagram illustrating a curve showing the change of the angle of inclination of the front flanks of the prisms as a function of the prism number counted from the normal.

Based on the above-discussed geometric relationships, FIG. 5 illustrates the curve which represents the frontal flank angle of the prisms as a function of the number of prisms counted from the normal plane. If now either the distance of the light source from the diffuser disc is changed (for example, reduced) or there is desired a higher light intensity in the zone of the indentation of the light distribution curve, the flank angle of the base flank (prism No. 1) is chosen smaller; thus, the course of the curve shown in FIG. 5 will be flatter. It is seen that the rate of change is the greatest close to the base prism (prism No. 1); the rate of change gradually drops in the zone of the higher prism numbers.

Figure 6:
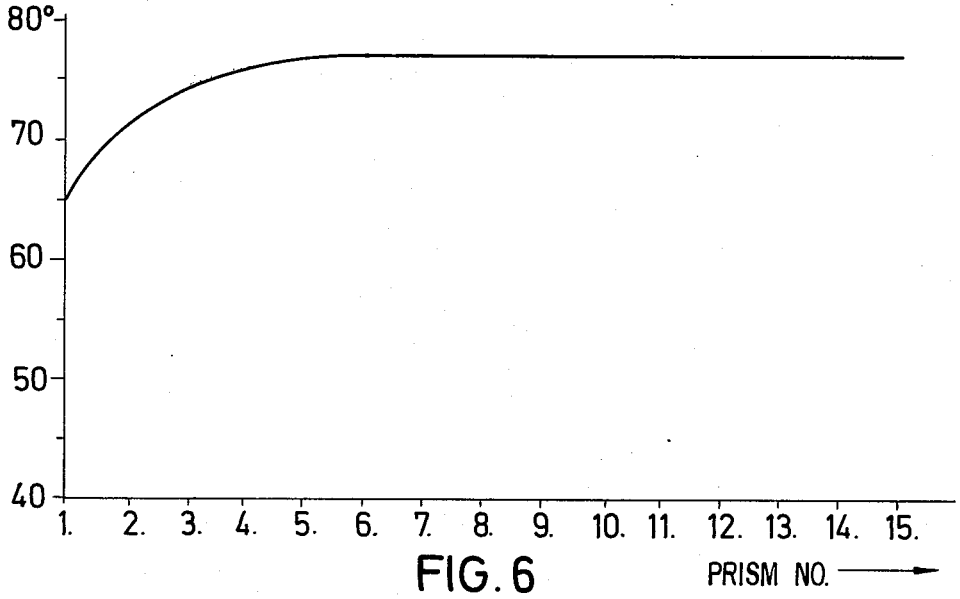
FIG. 6 is a diagram illustrating a curve showing the change of the angle of inclination of the rear flanks of the prisms as a function of the prism number counted from the normal.

Turning now to FIG. 6, the curve shown therein represents the rear flank angle of the prisms as a function of the number of prisms counted from the normal plane. It is well seen in FIG. 6 that starting from a minimum predetermined value of the rear flank angle which is associated with the first prism an which has a predetermined relationship to the flank angle of the base flank, the rear flank angles increase in the direction away from the normal plane 3 and further, the rate of increase diminishes in the same direction and the curve approximates a predetermined maximum in an asymptotic manner.

The values which are associated with the curves in FIGS. 5 and 6 are based on the refractive index of an acrylic resin (such as Lucite of Plexiglas). Dependent upon the refractive index of the chosen material for the diffuser disc, the curves of FIGS. 5 and 6 will shift.

The prisms described above in connection with FIGS. 3 to 6 constitute a primary prism structure. According to the invention, the reverse face of the diffuser disc may be provided with a secondary prism structure now to be described in connection with FIG. 3*a*.

The secondary prism structure of FIG. 3*a* comprises uniform prisms 7 of symmetrical cross section. These prisms extend in a direction perpendicular to the prisms of the primary prism structure on the other face of the light diffuser disc. The opening angle *y* between two prism flanks should be greater than 90° in order to prevent total reflections which would cause the light emanating from the light source to be reflected back into the lamp housing. The magnitude of the angle *y* also depends from the index of refraction of the disc material.

Turning now to FIG. 7, there is schematically illustrated an example of an entire lamp structured according to the invention. This lamp has two fluorescent tubes 1, 1' (shown in cross section) supported in a housing 8 in a conventional manner. The light outlet opening of the housing 8 is covered by the light diffuser disc 2 (also shown in cross section) which is structured according to the invention and which, with respect to the central plane 9 of the entire lamp has prism structures of symmetrical configuration (mirror image). Each portion of the diffuser disc 2 which is situated below a light source 1 or 1' has a structure according to that shown in FIG. 3. Thus, the prism structure is symmetrical with regard to the normal plane 3 containing the longitudinal axis of the light source 1 and the normal plane 3' containing the longitudinal axis of the light source 1'. This arrangement further illustrates the significance of the rear prism flanks which have the function to receive the light rays emanating from the other, remote light source of the lamp and also, to receive the light reflected from the housing walls and to deflect these light rays in accordance with the desired light distribution curve. The depth of the indentation of the heart-shaped light distribution curve according to FIG. 2 shows the advantages of the light deflection accomplished with the aid of the diffuser disc 2: the preponderant portion of the light rays are deflected away from the normal plane. The light distribution curve $C_{90}$ shown in FIG. 2 characterizes the light distribution of a lamp (provided with a fluorescent tube) in a direction parallel to the longitudinal central plane of the lamp, as effected by a secondary prism structure provided on the outer face of the light diffuser disc and as described in connection with FIG. 3*a*.

It is also feasible to arrange the light diffuser disc 2 in the lamp housing in such a manner that the primary prism structure shown in FIG. 3 is facing outwardly, whereas the secondary prism structure of FIG. 3*a* is oriented towards the light source. It is noted, however, that the best results are accomplished when the disc 2 is so oriented that the primary prism structure is oriented towards the light source. This arrangement has the further advantage that the optical image of the diffuser is better since the transversely extending symmetrical prisms of the secondary prism structure have a uniform surface configuration through which the prism structure of FIG. 3 can be seen only as transversely extending lines.

The lamp described in connection with FIGS. 3, 3*a* and 7 has a substantially linear light source and thus the prisms of the primary prism structure extend linearly and parallel to one another; further, the primary prism structure is symmetrical with respect to the normal which is a plane.

The invention, however, is not limited to an elongated lamp: it can find application, for example, in a lamp which has a substantially point-like light source, such as an incandescent bulb. In such a case, the normal is not a plane, but a line that passes through the center point of the bulb and is perpendicular to the faces of the diffuser disc. The prisms of the primary prism structure extend in concentric circles about the normal line which passes through the apex (foot) of the concave conical surface constituting the base flank (that is, the frontal flank of the first prism annulus surrounding the normal line). It is noted that the cross section of such a primary prism structure is identical to that illustrated in FIG. 3. The prisms of the secondary prism structure on the reverse face of the light diffuser disc extend radially outwardly from the normal line. The light distribution curve pertaining to a light diffuser disc structured according to the invention for use with a point-like light source corresponds to the curve $C_0$ of FIG. 2 for all planes containing the normal line.

It has been found to be particularly advantageous to provide the light source with a reflecting layer at least over one part of its side oriented away from the diffuser disc. In this manner, the proportion of light rays reflected by the inner walls of the lamp housing is at least reduced and thus the proportion of the directed or, as the case may be, deflected light rays is increased. The reflecting layer may either form part of the glass envelope of the light source or may be provided within the housing as an additional lamp component oriented towards the light source, so that the light source is situated between the reflecting surface and the light diffuser disc. The extent of indentation of the heart-shaped light distribution curve will also depend on the effect of the upper closure of the lamp.

It will be understood that the above description of the present invention is susceptible to various modifications, changes and adaptations, and the same are intended to be comprehended within the meaning and range of equivalents of the appended claims.

What is claimed is:

1. In a lamp including a light source having a center and a light diffuser disc having two opposite faces and supported at a distance from the light source; the improvement comprising a prism structure on one face of said light diffuser disc, said prism structure being symmetrical with respect to a normal passing through the center of the light source and being perpendicular to the faces of said light diffuser disc, said prism structure being formed of a plurality of prisms extending parallel to one another, each prism having a frontal flank oriented towards the normal and a rear flank oriented away from the normal; the angle of inclination of the frontal flanks gradually decreasing from prism to prism in a direction away from the normal and the angle of inclination of the rear flanks gradually increasing, at a decreasing rate, from prism to prism towards an upper limit value in a direction away from the normal.

2. A lamp as defined in claim 1, wherein the ratio of the distance between the center of the light source and the light diffuser disc to the diameter of the light source is approximately between 1.2 and 2.0.

3. A lamp as defined in claim 2, wherein said ratio is approximately between 1.4 and 1.5.

4. A lamp as defined in claim 1, wherein said prism structure constitutes a primary prism structure; the improvement further comprising a secondary prism structure provided on that face of said light diffuser disc which is opposite from the face carrying said primary prism structure; said secondary prism structure being formed of a plurality of linearly extending prisms oriented perpendicularly to the prisms of the primary prism structure; the prisms of said secondary prism structure being uniform and each having a symmetrical cross section; any two adjoining prisms of said secondary prism structure have facing flanks that define an opening angle greater than 90°.

5. A lamp as defined in claim 1, wherein said prism structure is provided on that face of said light diffuser disc which is oriented towards said light source.

6. A lamp as defined in claim 1, further comprising a light reflecting surface oriented towards said light source; said light source being situated between said light reflecting surface and said light diffuser disc.

7. A lamp as defined in claim 1, wherein said light source is substantially linear and has a longitudinal axis; said normal is a plane containing said axis; said prisms extend linearly and parallel to said normal plane.

8. A lamp as defined in claim 7, wherein said prisms extend parallel to said longitudinal axis of said light source.

9. A lamp as defined in claim 7, wherein the frontal flanks belonging to the two prisms adjoining said normal plane on the one and the other side thereof have a common foot line lying in said normal plane.

10. A lamp as defined in claim 1, wherein said light source is substantially point-like having a center point, said normal is a line containing said center point; said prisms extend concentrically with respect to the normal line.

11. A lamp as defined in claim 10, wherein the frontal flank belonging to the prism adjoining said normal line has a concave conical surface, the apex of which lies in said normal line.

12. A lamp as defined in claim 1, wherein the frontal flank of the prism closest to the normal has a foot lying in the normal.

13. A lamp as defined in claim 12, wherein the angle of inclination of the frontal flank belonging to the prism closest to the normal divided by the refractive index of the material of the light diffuser disc is between 28° and 40°.

14. A lamp as defined in claim 13, wherein the ratio of the angle of inclination of the frontal flank belonging to the prism closest to the normal to the angle of inclination of the rear flank belonging to the same prism is approximately between 0.8 and 1.0.

15. A light diffuser disc adapted for use in a lamp and having two opposite faces, the improvement comprising a prism structure on one face of said light diffuser disc, said prism structure being symmetrical with respect to a normal being perpendicular to the faces of said light diffuser disc, said prism structure being formed of a plurality of prisms extending parallel to one another, each prism having a frontal flank oriented towards the normal and a rear flank oriented away from the normal; the angle of inclination of the frontal flanks gradually decreasing from prism to prism in a direction away from the normal and the angle of inclination of the rear flanks gradually increasing, at a decreasing rate, from prism to prism towards an upper limit value in a direction away from the normal.

16. A light diffuser disc as defined in claim 15, wherein the frontal flank of the prism closest to the normal has a foot lying in the normal.

17. A light diffuser disc as defined in claim 16, wherein the angle of inclination of the frontal flank belonging to the prism closest to the normal divided by the refractive index of the material of the light diffuser disc is between 28° and 40°.

18. A light diffuser disc as defined in claim 17, wherein the ratio of the angle of inclination of the frontal flank belonging to the prism closest to the normal to the angle of inclination of the rear flank belonging to the same prism is approximately between 0.8 and 1.0.

19. A light diffuser disc as defined in claim 15, wherein said prism structure constitutes a primary prism structure; the improvement further comprising a secondary prism structure provided on that face of said light diffuser disc which is opposite from the face carrying said primary prism structure; said secondary prism structure being formed of a plurality of linearly extending prisms oriented perpendicularly to the prisms of the primary prism structure; the prisms of said secondary prism structure being uniform and each having a symmetrical cross section; any two adjoining prisms of said secondary prism structure have facing flanks that define an opening angle greater than 90°.

20. A light diffuser disc as defined in claim 15, wherein said normal is a plane; said prisms extend linearly and parallel to said plane.

21. A light diffuser disc as defined in claim 20, wherein the frontal flanks belonging to the two prisms adjoining said plane on the one and the other side thereof have a common foot line lying in said plane.

22. A light diffuser disc as defined in claim 15, wherein said normal is a line; said prisms extend concentrically with respect to said line.

23. A light diffuser disc as defined in claim 22, wherein the frontal flank belonging to the prism adjoining said normal line has a convave conical surface, the apex of which lies in said line.

* * * * *